US008007134B2

(12) United States Patent
Allegri

(10) Patent No.: US 8,007,134 B2
(45) Date of Patent: Aug. 30, 2011

(54) DIFFUSED LIGHT PROJECTOR

(75) Inventor: Fabio Allegri, Castel Goffredo (IT)

(73) Assignee: Coemar S.p.A., Castel Goffredo (IT)

( * ) Notice: Subject to any disclaimer, the term of this patent is extended or adjusted under 35 U.S.C. 154(b) by 280 days.

(21) Appl. No.: 12/425,727

(22) Filed: Apr. 17, 2009

(65) Prior Publication Data

US 2009/0268466 A1 Oct. 29, 2009

(30) Foreign Application Priority Data

Apr. 24, 2008 (IT) ..... PR2008A0030

(51) Int. Cl.
*F21V 17/02* (2006.01)

(52) U.S. Cl. ..... 362/282; 362/323; 362/331

(58) Field of Classification Search ..... 362/268, 362/277, 281–284, 319, 323, 324, 326, 331
See application file for complete search history.

(56) References Cited

U.S. PATENT DOCUMENTS

| | | | | |
|---|---|---|---|---|
| 5,068,768 | A * | 11/1991 | Kobayashi | 362/539 |
| 5,138,540 | A * | 8/1992 | Kobayashi et al. | 362/268 |
| 5,416,681 | A | 5/1995 | Wu | |
| 5,980,066 | A * | 11/1999 | Belliveau et al. | 362/281 |
| 7,217,002 | B2 * | 5/2007 | Jungel-Schmid et al. | 362/147 |
| 7,465,054 | B2 * | 12/2008 | Howard et al. | 353/122 |
| 2006/0187654 | A1 | 8/2006 | Jungel-Schmid et al. | |
| 2008/0158884 | A1 | 7/2008 | Joergensen et al. | |

FOREIGN PATENT DOCUMENTS

| | | | |
|---|---|---|---|
| EP | 1649212 | A1 | 1/2007 |
| WO | 2007045242 | A1 | 4/2007 |

* cited by examiner

*Primary Examiner* — Hargobind Sawhney
(74) *Attorney, Agent, or Firm* — Pearne & Gordon LLP

(57) ABSTRACT

Diffused light projector comprising:
a light source;
a main lens acting on the beam of light coming from the light source, said main lens being a Fresnel lens or a plano-convex lens to diffuse incident beam or beams of light;
at least one prismatic lens located between the light source and the main lens to condition the beam of light coming from said light source.

11 Claims, 3 Drawing Sheets

DIFFUSED LIGHT PROJECTOR

The present invention has as its subject a diffused light projector used in the show business sector to create extremely versatile lighting effects.

The diffused light projector is widely used in theatrical and cinema performances and also in concerts. This projector also has a common application both in the illumination of internal spaces (for example in discos) and in the illumination of external spaces (think of architectural lighting systems for buildings and monuments).

Existing diffused light projectors on the market are for the most part composed of a light source, a reflector, possibly filters and a light diffuser, i.e. a Fresnel or plano-convex lens (commonly indicated by the acronym PC). These projectors, commonly known by the English term "wash lights" to indicate the sensation that they deliver of bathing in light, may be fixed or movable, with various widths of angle of projection, and with the possibility of shaping the beam by means of a gobo. These projectors enable a designated area to be uniformly and statically lit with diffused light, using white or coloured light.

A principal disadvantage of the known art resides in the impossibility of producing a plurality of fixed or moving beams of diffused light originating from a single light source. In fact, the reflector receives the light radiation emitted by the light source and conveys it so as to form a single beam of light which is sent to the diffuser. Diffusion is performed on the basis of the constructional characteristics of the lens which constitutes the diffuser itself.

Currently, techniques are known for the production of pluralities of sharp but not diffused beams of light. This property is usual in projectors of "spot" type which are available commercially, generally composed of a light source, a reflector, possibly filters and a system of lenses suitable for projecting sharp and defined images (diapositive type). With "spot" projectors, unlike "wash" projectors, various effects can be created, among them multiplying the projected image by using a special lens, maintaining the sharpness of its focus.

It is an object of the present invention to eliminate the above-mentioned disadvantages, and to make available a diffused light projector capable of dynamically producing a multiplicity of diffused beams of light originating from a single light source.

A further object of the present invention is to present a diffused light projector capable of producing fixed or rotating beams of light according to a plurality of movements so as to obtain scenographic effects.

Another object of the present invention is to make available a diffused light projector capable of producing mutually converging or diverging beams of light.

Said objects are fully achieved by the diffused light projector which is the subject of the present invention, which comprises the characteristics contained in claim 1 and the subsequent claims.

These and other objects will become clearer from the following description of a preferred embodiment, illustrated purely by way of non-limiting example in the attached drawings in which.

Figure 1:
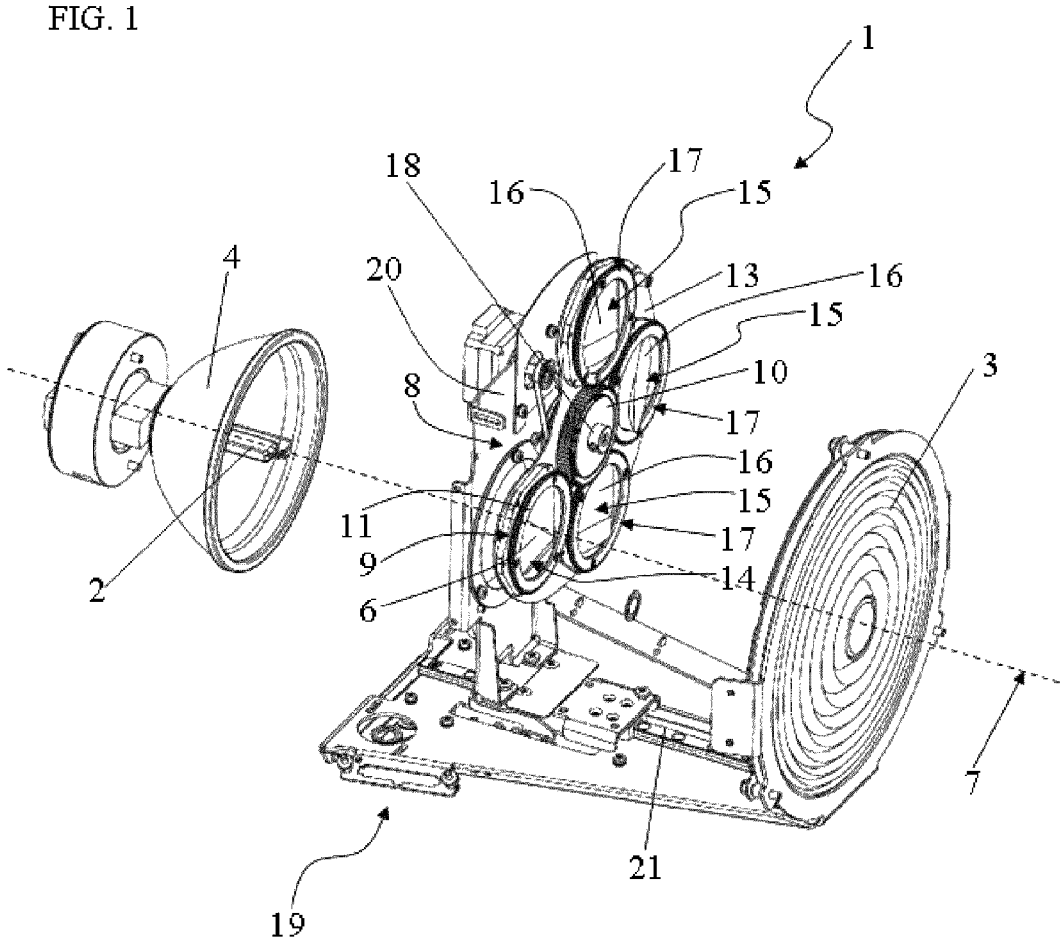
FIG. 1 illustrates a diffused light projector according to the present invention, in a perspective view.
Figure 2:
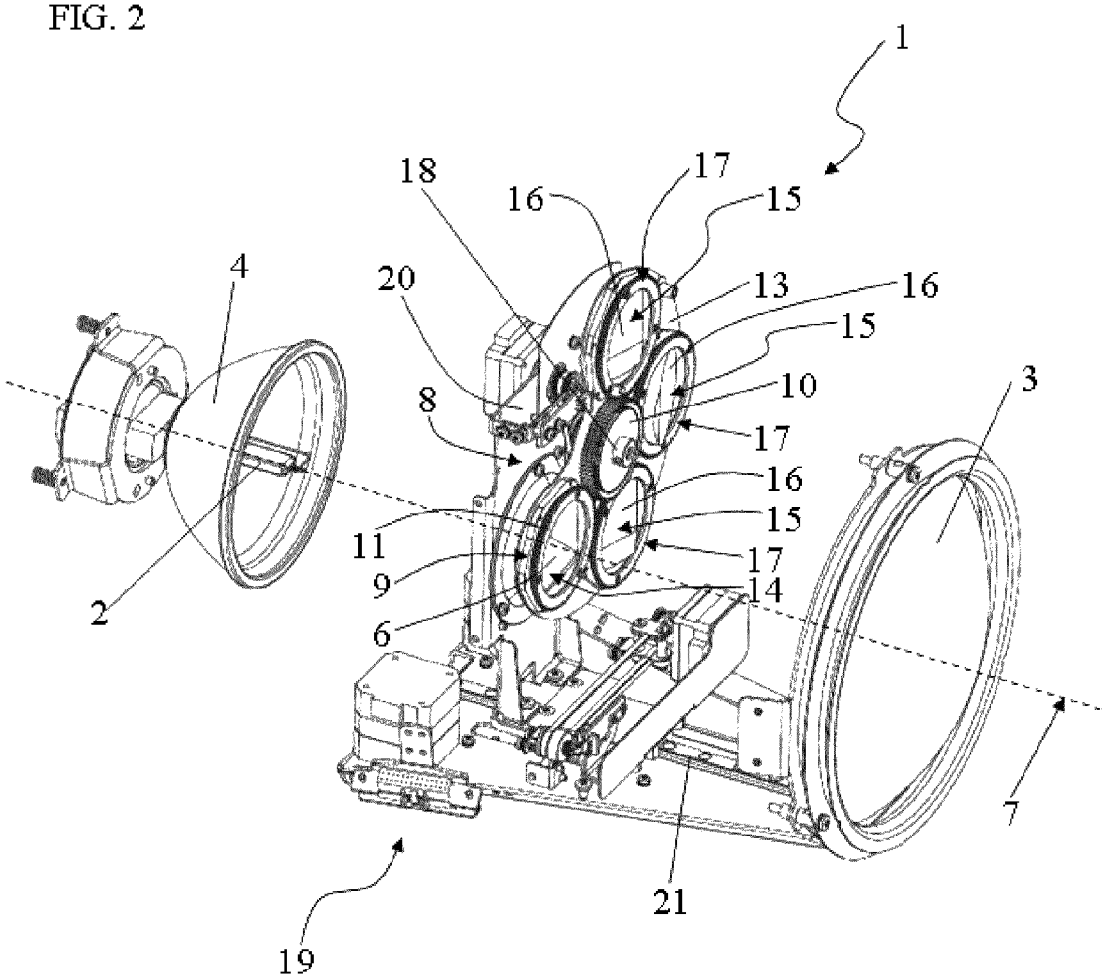
FIG. 2 illustrates the projector shown in FIG. 1, according to a different embodiment, in a perspective view.
Figure 3:
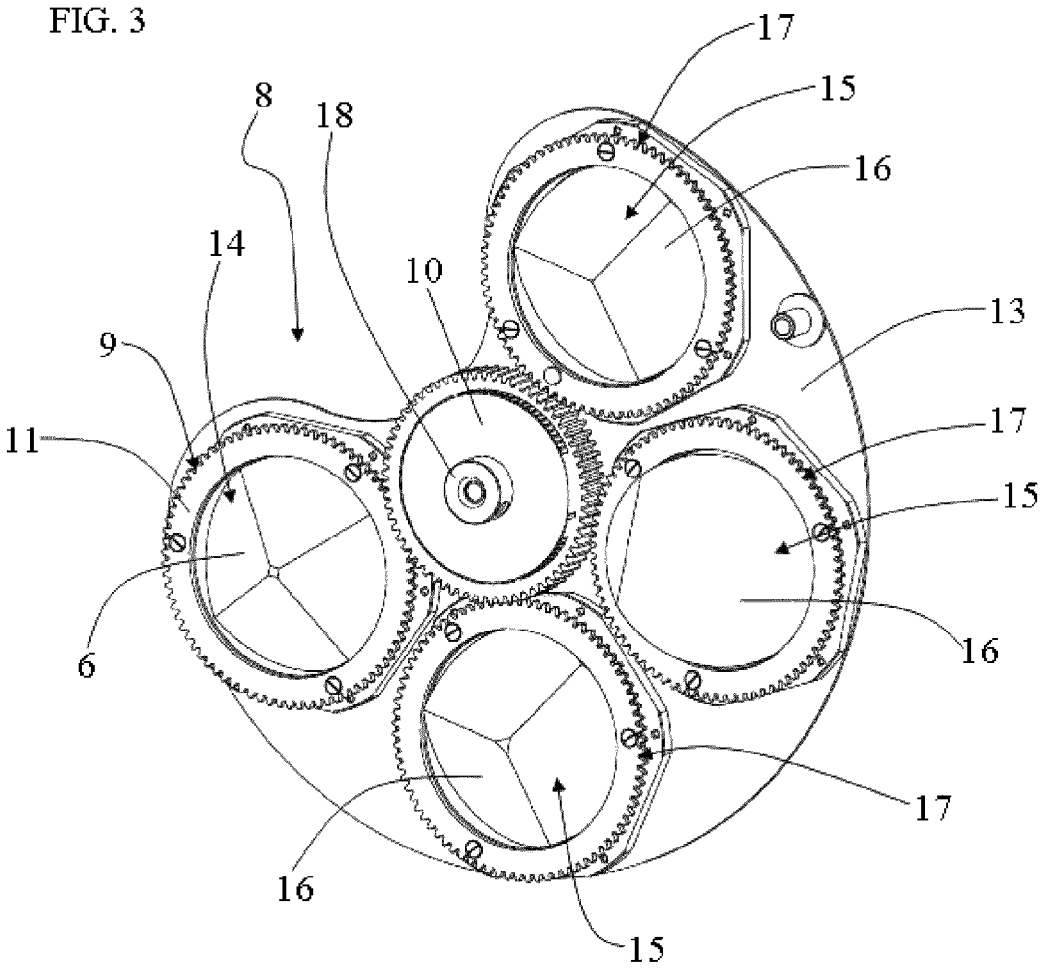
FIG. 3 illustrates a portion of the projector shown in FIG. 1, in a perspective view.
Figure 4:
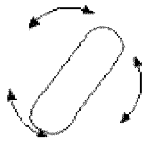
Figure 5:
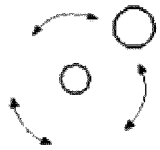
Figure 6:
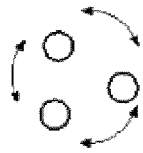
Figure 7:
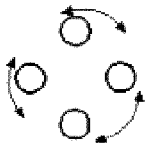
Figure 8:
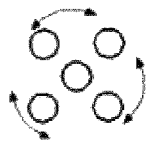

FIGS. 4 to 8 each illustrate an optical effect on the luminous areas projected by the projector shown in FIG. 1.

With reference to the drawings, no. 1 indicates a diffused light projector, in particular for use in the show business sector.

The projector 1 comprises a light source 2 and a main lens 3. The light source 2 can be of "discharge" type (for example, metal halide or xenon lamps) or of halogen (incandescent) type. Preferably, the light source 2 is provided with an optical element 4 which receives the beam of light issuing from it and contrives to convey it. This optical element 4 is often formed as a parabolic reflector or optical condenser.

The main lens 3 is made up of a plano-convex lens or a Fresnel lens having one side flat and frosted (not completely transparent), to diffuse the beam of light incident upon the flat side itself. Usually, there is a preference for using a Fresnel lens because it is more compact and lighter than a plano-convex lens. It should be noted that frosting the flat side does not allow sharp images to be transmitted, but produces precisely the effect of diffusing the light, as desired.

Advantageously and originally, between the light source 2 and the main lens 3, at least one prismatic lens 6 is placed. Preferably, the centre of the light source 2 and the centres of curvature of the main lens 3 and the prismatic lens 6 form a single optical axis 7. This optical axis 7 identifies the principal direction of propagation of the light.

The prismatic lens 6 can rotate around an axis that is longitudinal to it. Preferably, this prismatic lens 6 rotates around the optical axis 7. The rotation of the prismatic lens 6 is made possible by rotating means 8 comprising a toothed wheel 9 attached to the prismatic lens 6 and a toothed driving wheel 10. In particular, the toothed wheel 9, which is integral with the prismatic lens 6, has the form of a toothed ring-gear 11 which surrounds the prismatic lens 6 and meshes with the toothed driving wheel 10.

Preferably, the prismatic lens 6 is supported by a pierced plate 13, to which the toothed driving wheel 10 is also attached. Indeed, the pierced plate 13 has at least one hole 14 into which the prismatic lens 6 is fitted. The ring-gear 11 is fixed to the pierced plate 13 in such a way as to extend substantially around the hole 14, while surrounding the prismatic lens 6.

Preferably, the pierced plate 13 has a plurality of additional holes 15, into which an equal number of additional prismatic lenses 16 is fitted. Each of these additional prismatic lenses 16 is connected integrally to an additional toothed wheel 17, which meshes with the toothed driving wheel 10.

Advantageously, the pierced plate 13 is connected to a shaft 18 in such a way that the pierced plate 13 is pivoted rotatably around the shaft 18. By rotating the pierced plate 13 around this shaft 18, it is possible to set up one of the additional prismatic lenses 16 in place of the prismatic lens 6.

Advantageously, both the prismatic lens 6 and the additional prismatic lenses 16 can have various profiles so as to obtain multiple optical effects. In fact, they can have one or more facets in such a way as to produce a single beam of light or a plurality of beams of light.

The prismatic lens 6 can move along the optical axis 7, describing a route between the light source 2 and the main lens 3. This movement is performed by means 19 for moving the prismatic lens 6 comprising a support 20 for carrying the prismatic lens 6 itself and a guide 21 on which the support 20 is slidably mounted. Preferably, means 19 for moving act directly on the pierced plate 13, and the support 20 supports the pierced plate 13 itself.

The rotation of the prismatic lens 6 and its movement along the optical axis 7 can be performed manually or automatically (for example by means of a servo motor).

In an alternative embodiment (not illustrated), a secondary lens (plano-convex or biconvex, for example) is inserted on the optical axis 7 between the light source 2 and the main lens 3, in such a way as to further condition the beam or beams of light.

The operation of the diffused light projector according to the present invention is substantially as follows.

The beam of light issuing from the light source 2 and suitably conveyed by the optical element 4 is broken up by the prismatic lens 6 into as many beams of light as there are facets on this prismatic lens 6. The beams of light thus generated strike the main lens 3 which, having its flat side frosted, diffuses the light. Projecting the light onto a flat surface forms a number of spots equal to the number of beams of light incident upon the surface itself.

Rotating the toothed driving wheel 10 also rotates the ring-gear 11 and the prismatic lens 6 which is integral with it. In this way, the beams of light issuing from the main lens 3 are rotated, and the relative spots projected onto the surface undergo a similar rotation.

Sliding the support 20 for the pierced plate 13 along the guide 21 makes the prismatic lens 6 slide along the optical axis 7, allowing it to restrict or expand the width of the beams of light.

If it is desired to change the shape of the beams of light, it is sufficient to rotate the pierced plate 13 around the shaft 18 in such a way as to replace the prismatic lens 6 in use with one of the additional prismatic lenses 16 mounted on the pierced plate 13 itself.

Alternatively, varying the dimensions of the beams of light can be achieved by keeping the support 20 for the pierced plate 13 fixed and inserting the secondary lens between the light source 2 and the main lens 3. In particular, the secondary lens is located between the optical element 4 and the main lens 3.

The characteristics of the diffused light projector according to the present invention are clear from the description given above, as also are the advantages.

In particular, interposing at least one prismatic lens (with one or more facets) between the light source and the main lens (Fresnel or plano-convex) makes it possible to produce a multiplicity of diffused beams of light originating from a single light source.

In addition, the prismatic lens can assume all the intermediate positions between the light source and the main lens, allowing the beams of light produced to be made to mutually converge or diverge, and these beams then to be projected onto a surface.

In addition, as a result of the wide variety of profiles of the facets of the prismatic lens, it is possible to obtain different shapes for the beams of light. For example, in the case of a prismatic lens with a single inclined facet, an eccentric effect is obtained, possibly rotating if the prismatic lens itself is rotated.

Finally, rotating the prismatic lens itself around a longitudinal; axis (typically its axis of symmetry) enables rotating beams of light, and a projection of dynamic lighting effects, to be obtained.

The invention claimed is:

1. Diffused light projector comprising:

a light source;

a main lens acting on the beam of light coming from the light source, at least one prismatic lens located between the light source and the main lens to condition the beam of light coming from said light source, said main lens being a Fresnel lens or a plano-convex lens to diffuse incident beam or beams of light;

means for rotating the prismatic lens around an axis longitudinal to said prismatic lens, said means for rotating including a toothed wheel connected to the prismatic lens and integral with it and a toothed driving wheel in mesh with said toothed wheel in order to make it rotate, wherein the projector also includes a pierced plate supporting the prismatic lens and the toothed driving wheel.

2. Projector according to claim 1, wherein the projector includes a plurality of additional prismatic lenses housed in an equal number of additional holes in the pierced plate and connected integrally to an equal number of additional toothed wheels which mesh with the toothed driving wheel, the pierced plate being pivoted rotatably around a shaft connected to the pierced plate itself in such a way that each of the additional prismatic lenses can be set up in place of prismatic lens.

3. Projector according to claim 2, wherein the additional prismatic lenses have one or more facets in order to obtain a single beam of light or a plurality of beams of light.

4. Projector according to claim 1, wherein the projector is provided with means for moving the prismatic lens along a route between the light source and the main lens.

5. Projector according to claim 4, wherein the means for moving include a support for carrying the prismatic lens and a guide on which the support is slidably mounted.

6. Projector according to claim 1, wherein the projector includes means for moving the pierced plate along a route between the light source and the main lens.

7. Projector according to claim 6, wherein the means for moving comprise a support for carrying the pierced plate and a guide on which the support is slidably mounted.

8. Projector according to claim 1, defining an optical axis passing through the centre of the light source and the centres of curvature of the main lens and of the prismatic lens in such a way that the beam of light coming from the light source travels substantially in the direction of said optical axis.

9. Projector according to claim 1, including at least one secondary lens located between the light source and the main lens to condition the beam or beams of light.

10. Projector according to claim 1, including an optical element connected to the light source in such a way as to receive and convey the beam of light coming from the light source itself.

11. Projector according to claim 1, wherein the prismatic lens has one or more facets in order to obtain a single beam of light or a plurality of beams of light.

* * * * *